US008476971B2

(12) United States Patent
Peng et al.

(10) Patent No.: US 8,476,971 B2
(45) Date of Patent: Jul. 2, 2013

(54) BUFFER OPERATIONAL AMPLIFIER WITH SELF-OFFSET COMPENSATOR AND EMBEDDED SEGMENTED DAC FOR IMPROVED LINEARITY LCD DRIVER

(75) Inventors: Yung-Chow Peng, Hsinchu (TW); Wen-Shen Chou, Taipei (TW); Ching-Ho Chang, Hsinchu (TW); Wan-Te Chen, Danshui Township, Taipei County (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 141 days.

(21) Appl. No.: 12/889,492

(22) Filed: Sep. 24, 2010

(65) Prior Publication Data

US 2011/0279150 A1 Nov. 17, 2011

Related U.S. Application Data

(60) Provisional application No. 61/334,629, filed on May 14, 2010.

(51) Int. Cl.
*G06G 7/12* (2006.01)

(52) U.S. Cl.
USPC ..... 327/560; 330/262

(58) Field of Classification Search
USPC ..... 327/560–563; 330/9, 262–265, 267–268
See application file for complete search history.

(56) References Cited

U.S. PATENT DOCUMENTS 5,396,245 A * 3/1995 Rempfer ..... 341/145
5,731,774 A * 3/1998 Fujii et al. ..... 341/144
5,859,606 A * 1/1999 Schrader et al. ..... 341/144
6,246,351 B1 * 6/2001 Yilmaz ..... 341/145
6,380,801 B1 * 4/2002 McCartney ..... 330/9
6,388,521 B1 * 5/2002 Henry ..... 330/258
6,426,674 B1 * 7/2002 Davidescu ..... 330/9
6,573,783 B2 * 6/2003 Gray ..... 330/9
7,164,291 B2 * 1/2007 Mair et al. ..... 326/83
7,170,347 B1 * 1/2007 Kindt ..... 330/253
7,605,657 B2 * 10/2009 Schelmbauer ..... 330/260
7,764,212 B2 * 7/2010 Lee et al. ..... 341/145
7,948,418 B2 * 5/2011 Cho et al. ..... 341/145
8,098,098 B2 * 1/2012 Fukuzawa ..... 330/259
2004/0160269 A1 * 8/2004 Tsuchi ..... 327/561
2007/0247218 A1 10/2007 Jang et al.
2008/0030489 A1 2/2008 Kim et al.
2008/0290909 A1 * 11/2008 Chung ..... 327/108
2008/0297390 A1 12/2008 Ko et al.
2009/0085788 A1 * 4/2009 Yamazaki et al. ..... 341/153
2009/0278865 A1 11/2009 Kang et al.

* cited by examiner

OTHER PUBLICATIONS

Kang, J.S. et al., "10-bit Driver IC Using 3-bit DAC Embedded Operational Amplifier for Spatial Optical Modulators (SOMs)", IEEE Journal of Solid-State Circuits, Dec. 2007, 42(12):2913-2922.

*Primary Examiner* — Thomas J Hiltunen
(74) *Attorney, Agent, or Firm* — Duane Morris LLP

(57) ABSTRACT

A driver utilizes selective biasing of the terminal of an operational amplifier to reduce offset in the operational amplifier output. Each operational amplifier input includes a differential input pair of transistors including a NMOS transistor and PMOS transistor. At low and high ends of the input voltage range these transistors are selectively and individually coupled to either a standard input or biased to be on so as to contribute offset for offset compensation. The transistors are biased in a conventional manner for input voltages between the low and high ends of the voltage range.

19 Claims, 12 Drawing Sheets

Input 2V~16V
Normal Operation

| Data | | | Operational amplifier | | | | | | | | |
|---|---|---|---|---|---|---|---|---|---|---|---|
| | | | Input | | | | | | | | Output |
| 0 | 0 | 0 | VL | VL | VL | VL | VL | VL | VL | VL | VL |
| 0 | 0 | 1 | VL | VL | VL | VL | VL | VL | VL | VH | (7・VL+1・VH)/8) |
| 0 | 1 | 0 | VL | VL | VL | VL | VL | VL | VH | VH | (6・VL+2・VH)/8) |
| 0 | 1 | 1 | VL | VL | VL | VL | VL | VH | VH | VH | (5・VL+3・VH)/8) |
| 1 | 0 | 0 | VL | VL | VL | VL | VH | VH | VH | VH | (4・VL+4・VH)/8) |
| 1 | 0 | 1 | VL | VL | VL | VH | VH | VH | VH | VH | (3・VL+5・VH)/8) |
| 1 | 1 | 0 | VL | VL | VH | VH | VH | VH | VH | VH | (2・VL+6・VH)/8) |
| 1 | 1 | 1 | VL | VH | VH | VH | VH | VH | VH | VH | (1・VL+7・VH)/8) |

FIG. 3
(Prior Art)

Input 0V~2V
Only Turn On PMOS Input Pair
NMOS Input Pair Gate Connect to 9V

Input 2V~16V
Normal Operation

Input 16V~18V
Only Turn On NMOS Input Pair
PMOS Input Pair Gate Connect 9V

BUFFER OPERATIONAL AMPLIFIER WITH SELF-OFFSET COMPENSATOR AND EMBEDDED SEGMENTED DAC FOR IMPROVED LINEARITY LCD DRIVER

CROSS-REFERENCE TO RELATED APPLICATION

This application is a non-provisional application of and claims priority to U.S. Provisional Patent Application No. 61/334,629 having the same title filed May 14, 2010, the entirety of which is hereby incorporated by reference herein.

FIELD OF THE INVENTION

The present invention relates to LCD drivers, and more particularly to LCD drivers utilizing digital-to-analog (DAC) converters.

BACKGROUND OF THE INVENTION

Today's advanced electronics, such as high definition televisions, place ever increasing demands on electronics. For example, customers demand HDTV display systems that can display images with more and more natural colors. Typical LCD drivers for driving pixel arrays of an LCD display use digital-to-analog converters to convert digital codes representing voltage levels to corresponding analog outputs. For example, sixteen binary numbers can be expressed using 4-bits to represent output voltages of the DAC. An actual analog output voltage Vout is proportional to an input binary number, and is expressed as a multiple of the binary number. When the reference voltage Vref of the DAC is a constant, the output voltage Vout has only a discrete value, e.g., one of 16 possible voltage levels, so that the output of the DAC is not truly an analog value. However, the number of possible output values can be increased by increasing the number of bits of input data. A larger number of possible output values in the output range reduces the difference between DAC output values.

It should be apparent that when the DAC input includes a relatively large number of bits, the DAC provides a relatively high-resolution output. However, the circuit area consumed by the DAC increases proportionally with resolution. An increase by only 1 bit doubles the area of the decoder in the DAC.

By way of example, assume that the input data is 8 bits in a conventional R-type (resistive string) DAC. In this case, the DAC is configured with 256 resistors, 256 signal lines and one 256×1 decoder. Using this standard architecture, to fabricate a 10-bit DAC would require 1024 resistors, 1024 signal lines and one 1024×1 decoder. This DAC would consume four times as much chip or wafer area than a comparable 8-bit DAC.

Other problems also exist with conventional DACs. For example, conventional DAC's typically implement a sample and hold circuit using an operational amplifier (OP-AMP). Unfortunately, parasitic capacitance at an input terminal of the OP-AMP has an undesirable effect on an output of the DAC, namely off-set, when modulating a voltage level of a non-inverting input terminal of the OP-AMP. Moreover, the OP-AMP inputs are typically each configured with differential MOS pairs. The RMS offset can become out-of-spec when the input voltage is close to the MOS threshold voltages (Vth) of the differential pairs.

Jin-Seong Kang et al. have proposed in "10-bit Driver IC Using 3-bit DAC Embedded Operational Amplifier for Spatial Optical Modulators (SOMs)," IEEE Journal of Solid-State Circuits, Vol. 42, No. 12, December 2007, embedding part of the DAC in the OP-Amp circuitry to save area for higher resolutions (e.g., 10-bit). However, with this architecture the DAC linearity worsens with increases in resolution.

A new DAC architecture is desired with improved linearity and offset compensation.

SUMMARY OF THE INVENTION

A driver includes a digital-to-analog converter (DAC) having a digital input representing an input voltage between first and second analog voltage levels and an analog output. An operational amplifier has an output and first and second inputs. The first input has a first differential input pair of transistors including a first NMOS transistor and a first PMOS transistor. The second input has a second differential input pair of transistors including a second NMOS transistor and a second PMOS transistor. Switching logic is used to reduce offset in the operational amplifier. The switching logic is operable to selectively couple: the first NMOS and PMOS transistors to the analog output of the DAC and the second NMOS and PMOS transistors to the operational amplifier output when the input voltage is between a low reference voltage and a high reference voltage; the first and second NMOS transistors to an intermediate voltage between the low and high reference voltages, the first PMOS transistor to the analog output of the DAC and the second PMOS transistor to the operational amplifier output when the input voltage is below the low reference voltage; and the first and second PMOS transistors to the intermediate voltage, the first NMOS transistor to the analog output of the DAC and the second NMOS transistor to the operational amplifier output when the input voltage is above the high reference voltage.

In other embodiments, an operational amplifier buffer is provided having an embedded digital-to-analog converter. The structure includes a decoder having inputs for receiving first and second voltages and an n-bit input code, the decoder having $2^n$ number of outputs, each output being individually set to either the first or second voltage dependent on the input code. A first operational amplifier input is coupled to the decoder, the first operational amplifier including a first group of differential input pairs of transistors, each differential input pair being coupled to a respective one of the outputs of the decoder. A second operational amplifier input is coupled to an output of the operational amplifier. The second operational input includes a second group of differential input pairs of transistors, each differential input pair being coupled to the output of the operational amplifier. The first and second groups each include at least first and second subgroups of differential input pairs of transistors, the first subgroup comprising at least one differential input pair of transistors fabricated in accordance with a first size parameter and the second subgroup comprising at least one differential input pair of transistors fabricated in accordance with a second size parameter different than the first size parameter. An output circuit has inputs coupled to the first and second groups of differential input pairs of transistors and an output corresponding to the output of the operational amplifier.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which:

FIG. 3 is a table illustrating the operation of the driver of FIG. 1;

DETAILED DESCRIPTION

This description of the exemplary embodiments is intended to be read in connection with the accompanying drawings, which are to be considered part of the entire written description. Terms concerning electrical attachments, coupling and the like, such as "connected" and "interconnected," refer to a relationship wherein structures communicate with one another either directly or indirectly through intervening structures, unless expressly described otherwise.

Figure 1:
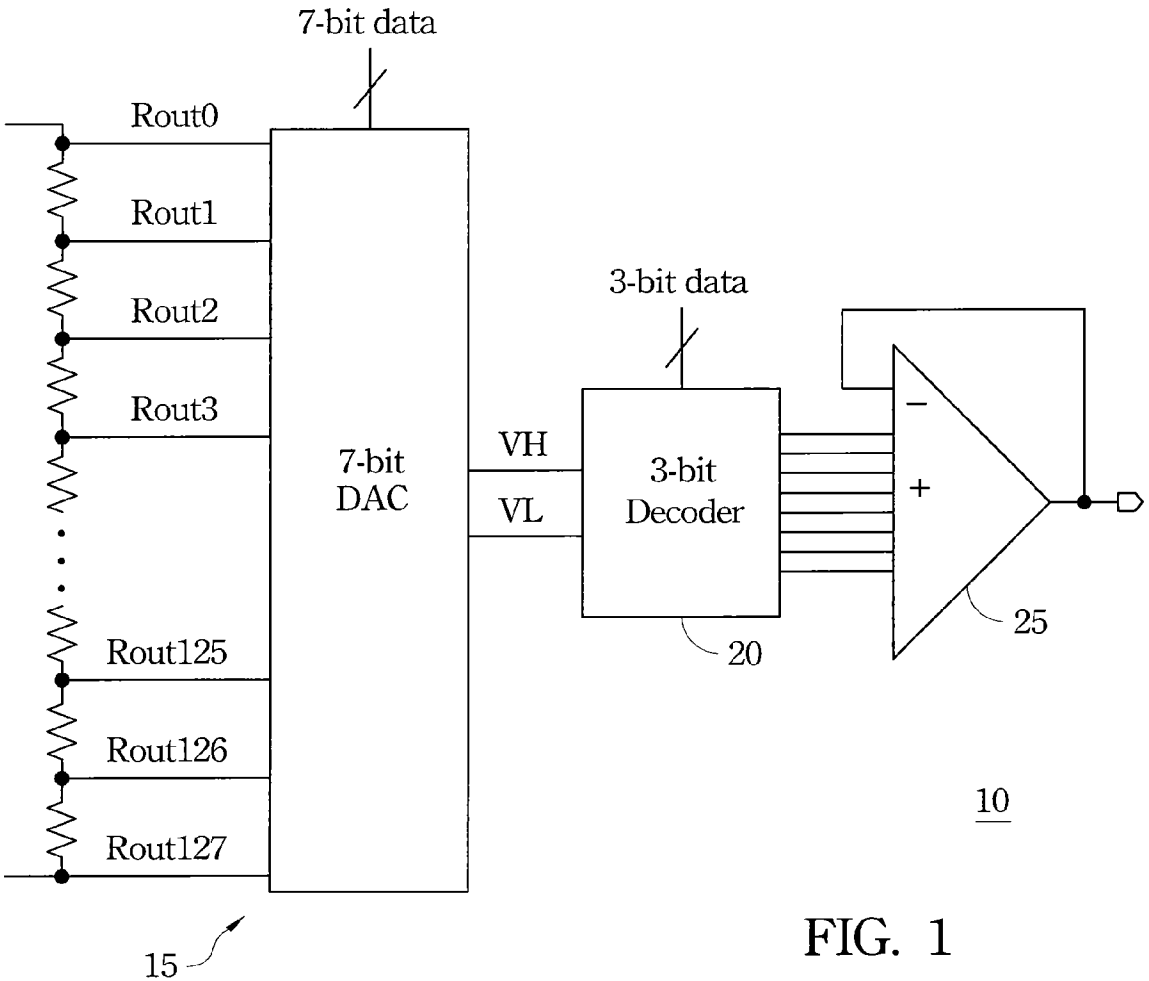
FIG. 1 (Prior Art)
FIG. 1 illustrate a 10-bit driver architecture having an embedded 3-bit DAC operational amplifier.

FIG. 1 is a diagram of a 10-bit driver 10 as described in Kang et al. and reprinted therefrom, the entirety of which is hereby incorporated by reference herein. To reduce the chip area consumed by the 10-bit driver, the 10-bit DAC required for the driver is split between a conventional 7-bit resistor-string DAC 15 and a unity-gain buffer, which has a 3-bit linear DAC built into the operational amplifier 25. The 7-bit resistor-string DAC 15 uses the 7 most significant bits of a 10-bit code to select two adjacent voltage levels (VH and VL), and the unity-gain buffer 25 with a 3-bit embedded DAC divides the voltage range between the two adjacent voltage outputs of the 7-bit DAC 15 into eight voltage levels. The three least significant bits of the 10-bit code are used by a 3-bit decoder 20 to provide the inputs to the embedded DAC. According to Kang et al., the total size of the 10-bit DAC is only 60% of that of a decoder-based 8-bit resistor-string DAC.

Figure 2:
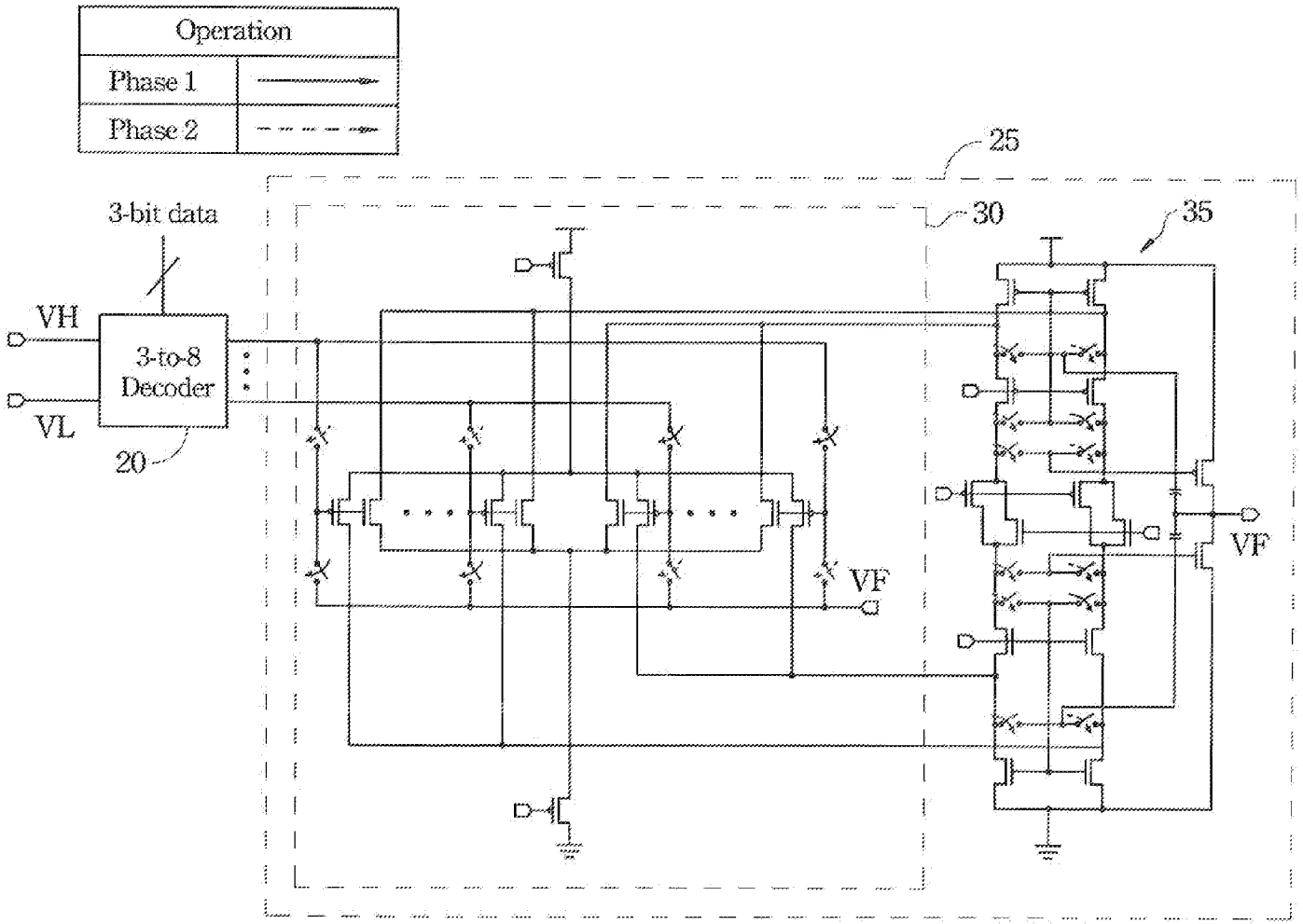
FIG. 2 (Prior Art)
FIG. 2 illustrates in more detail the operational amplifier structure of the driver of FIG. 1.

FIG. 2, reprinted from Kang et al, shows the whole schematic diagram of the operational amplifier 25, which contains a 3-bit DAC in its input stage 30 and some switches to reduce an offset voltage. The operational amplifier 25 also includes an output stage 35. VH an VL are selected from the 7-bit resistor-string DAC 15 (FIG. 1). The table in FIG. 3 shows the output voltage VF according to combinations of VH and VL and 3-bit data signals provided to the 3-to-8 decoder 20. The output voltage can range between VL and (VL+7VH)/8 and is evenly divided into eight levels. As such, the output buffer works as a 3-bit linear DAC. Various switches are provided for alternating the polarity of the offset voltage in every frame. According to Kang et al., this technique for offset cancellation is well suited for Spatial Optical Modulator (SOM) driver ICs because the SOM device projects the same image twice, and the offset can be temporally averaged by inverting the polarity of the offset voltage. The switches are operated in two phases, which are represented as phases 1 and 2 in FIG. 2. In phase 1, the switches in the solid line are "ON." In phase 2, the switches in the dotted line are "ON."

There are several deficiencies in the driver architecture illustrated by FIGS. 1-3. For example, the driver architecture has significant RMS offset when the input ranges across the full range of possible inputs. Moreover, the embedded DAC linearity worsens at higher resolutions. An improved driver architecture is described herein for addressing individually or together, in embodiments, these deficiencies.

In certain embodiments of the present invention, the biasing conditions for the input differential MOS pairs that form the positive and negative input terminals of a buffer operational amplifier, as can be used in a LCD driver, are controlled to reduce RMS offset in the buffer operational amplifier. This approach to RMS offset reduction is explained in connection with FIGS. 4 to 7.

Figure 4:
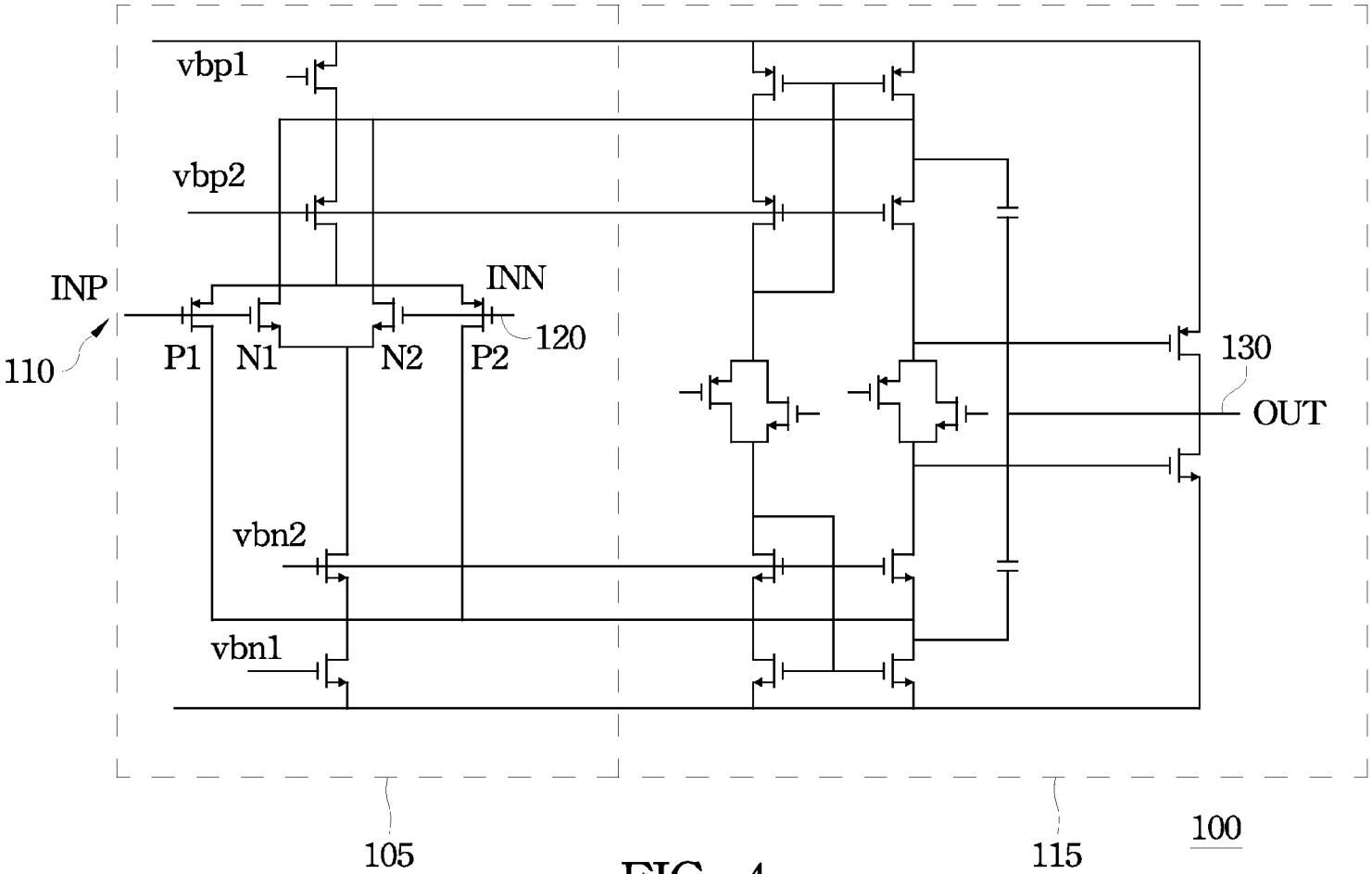
FIG. 4 illustrates an operational amplifier having positive and negative input terminal each formed from a differential input pair of transistors.

FIG. 4 is a circuit diagram of a conventional operational amplifier 100 having an input circuit or stage 105 and an output circuit or stage 115. The operational amplifier circuit and its operation are well known in the art and need not be described herein. The operational amplifier has a positive input 110 (labeled INP) and a negative inputs 120 (labeled INN) in input stage 105 and an output 130 in output stage 115. Of particular note, each input 110 and 120 includes a differential input transistor pair consisting of a PMOS transistor and an NMOS transistors. That is, input 110 has PMOS/NMOS pair P1/N1 having gates coupled to the INP node and input 120 has PMOS/NMOS pair P2/N2 having gates coupled to the INN node.

RMS Offset is defined as the high voltage offset (VHigh Offset) minus the low voltage offset (Vlow Offset). For example, if the target high voltage is 17V and the operational amplifier provides 17.5V, then VHigh Offset is 0.5 V. It is important to keep offset to a minimum in LCD drivers so as to avoid color distortion.

Figure 6:
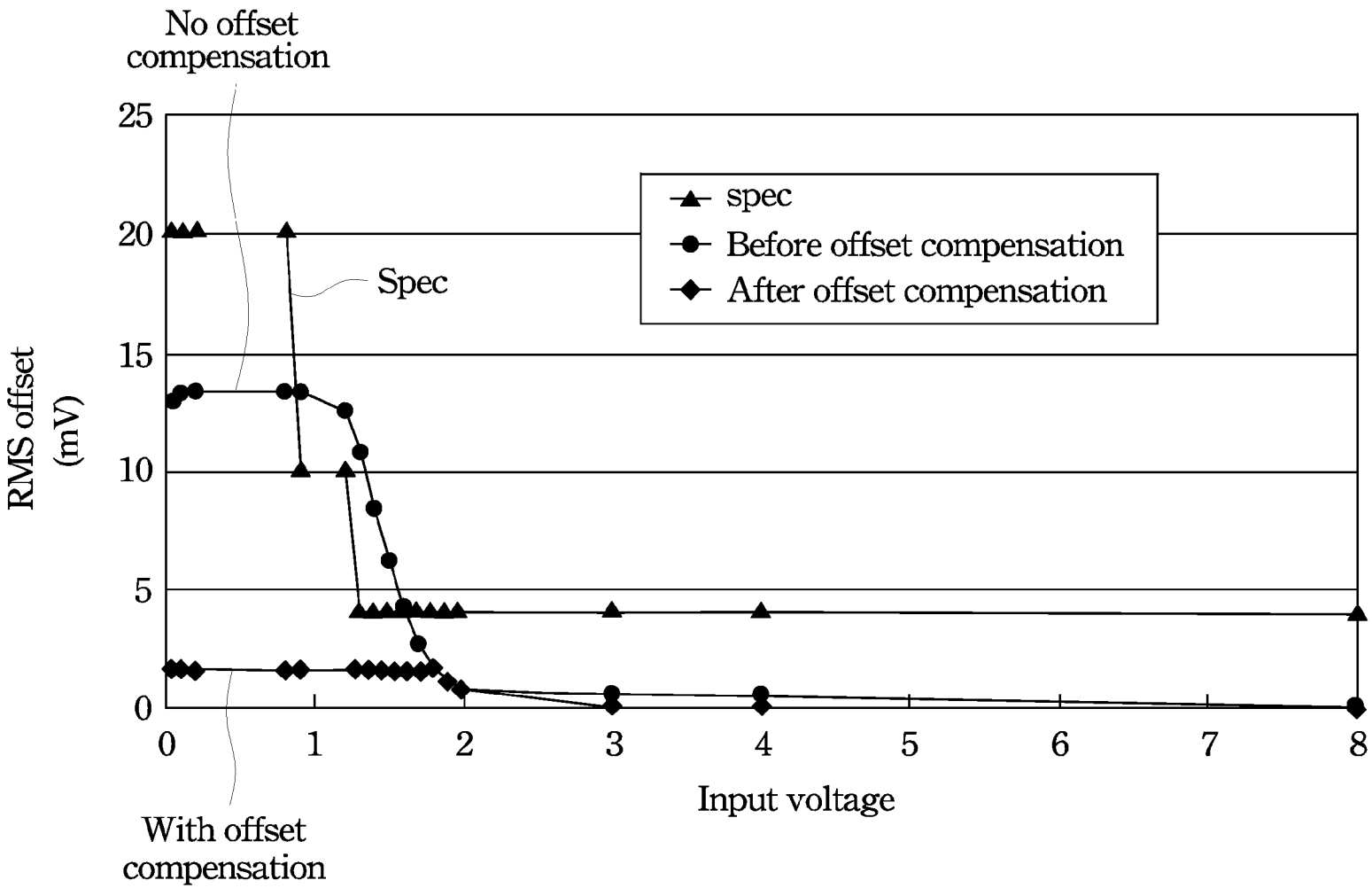
FIG. 6 is a graph showing a RMS offset specification and RMS offset of a circuit with and without RMS offset compensation.

FIG. 6 is a graph showing the RMS offset for the operational amplifier at different input voltages. The graph of FIG. 6 shows the target specification, which allows for more RMS offset at the extreme ends of the voltage range. For example, the allowable RMS offset for low voltages, e.g., 0V to 1.1V, is higher than that allowed for middle range voltages, e.g., starting around 1.1V. FIG. 6 also plots the RMS offset for the operational amplifier of FIG. 4 when no offset compensation is employed. As can be seen from FIG. 6, the RMS offset of this circuit is output spec at lower voltages, e.g., from about 0.8V to 1.5V.

Figure 5A:
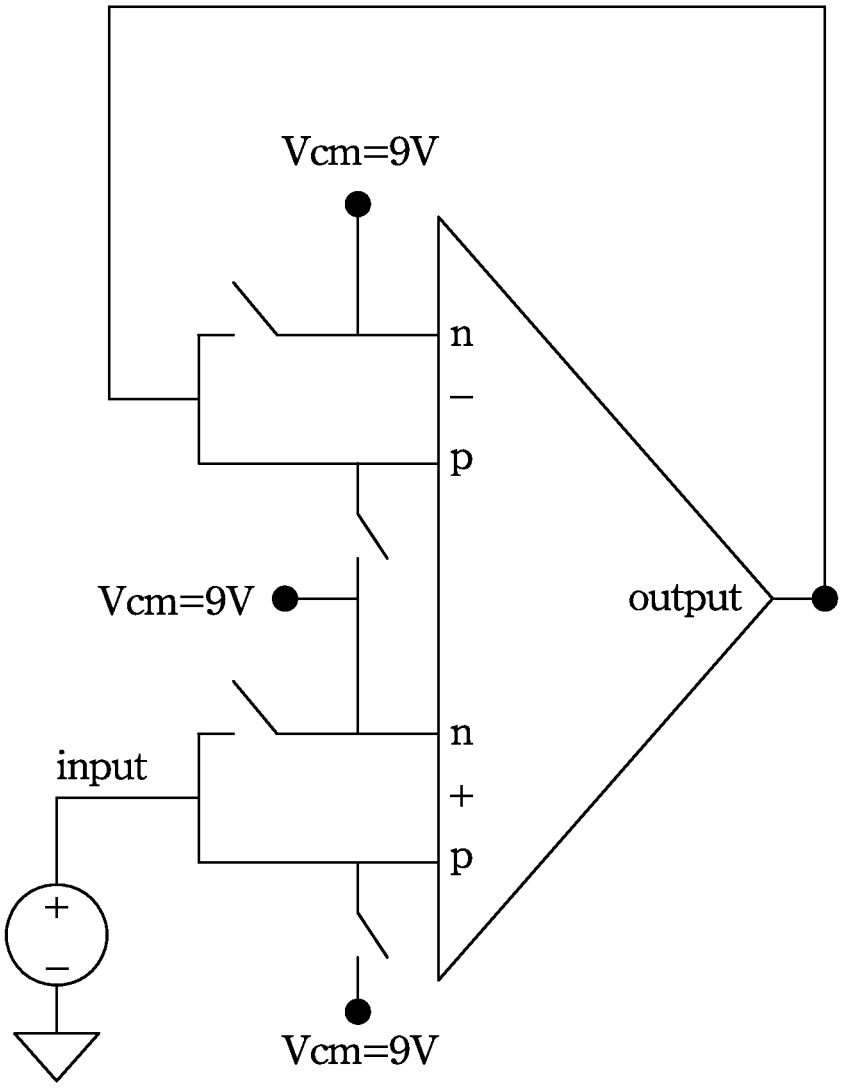
FIGS. 5A to 5C illustrate an embodiment of a selective biasing scheme for the inputs of an operational amplifier for reducing RMS offset.
Figure 5B:
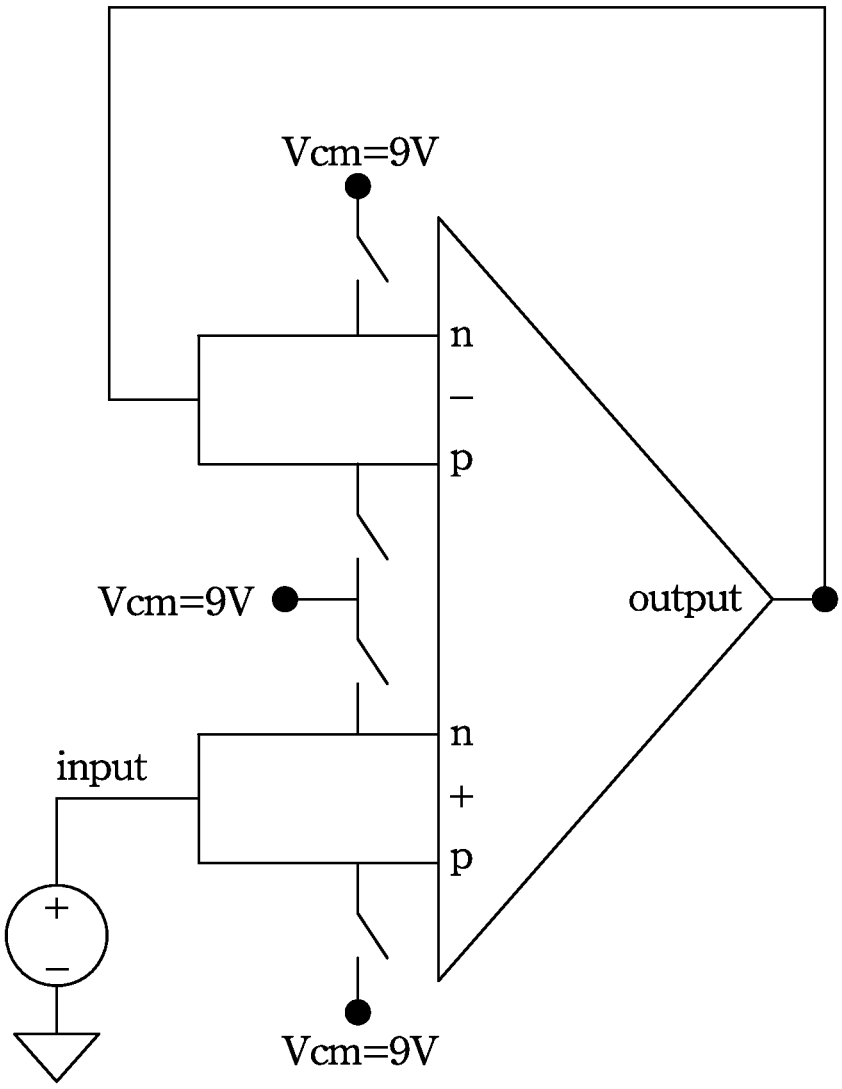
Figure 5C:
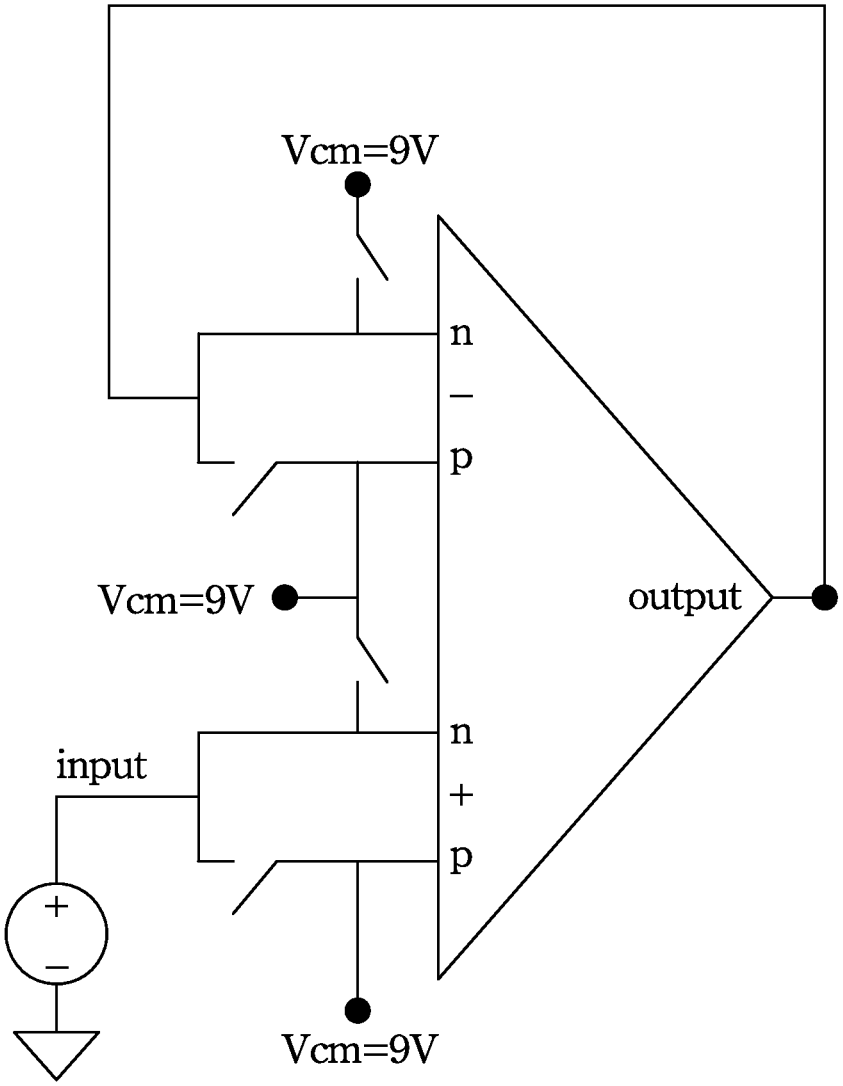

Turning to FIGS. 5A to 5C, a new approach to RMS offset compensation is illustrated. As shown in each of FIGS. 5A and 5C, the operational amplifier has a negative input and a positive input. Since each input includes an NMOS/PMOS pair as described above, both positive and negative inputs are shown as having both an NMOS input and a PMOS input. That is, "n" represents the gate terminal of the NMOS transistor of the given input and "p" represents the gate terminal of the PMOS transistor of the given input. In the illustrated example, it is assumed that the voltage input ranges from 0V to 18V. As such, the common mode voltage Vcm is 9V. The output of the operational amplifier is fed back to the negative input of the operational amplifier. The input voltage is coupled to the positive input of the operational amplifier. As discussed in more detail below, self-offset compensation is provided by selectively biasing the NMOS and PMOS transistors of the NMOS/PMOS pairs forming the operational amplifier inputs.

Turning to FIG. 5A, FIG. 5A shows the biasing conditions when the input voltage is low, e.g., about 0V-2V. When the input voltage is in this low range, only the PMOS input transistors are coupled to their conventional inputs. That is, the PMOS of the operational amplifier negative input is coupled to the operational amplifier output and the PMOS of the operational amplifier positive input is coupled to the input voltage. Unlike conventional biasing schemes, e.g., FIG. 4, where the NMOS/PMOS transistors of a given input are always biased together, the NMOS transistors of the inputs are biased with Vcm (e.g., 9V). With conventional biasing schemes where the NMOS/PMOS transistor pair of a given input are biased together, the RMS offset can be out-of-spec when the input voltage is close to the differential pairs threshold voltage Vth (NMOS) where the NMOS transistors will be off (or weekly on). The approach of FIG. 5A turns the NMOS transistors of the differential pair fully "on" at the low range of input voltages, when they would otherwise be "off" (or very weakly "on") if coupled to the input voltage, so that these NMOS transistors can contribute offset for RMS offset compensation.

Turning to FIG. 5B, the biasing scheme for when the input voltages are from about 2V to about 16V is shown, i.e., for the voltages that are not at the low and high end of the input voltage range. For these input voltages, the operational amplifier is biased in the conventional manner. That is, both the NMOS and PMOS transistors of the negative input are coupled to the output of the operational amplifier, and both the NMOS and PMOS transistors of the positive input are coupled to the input voltage.

Turning to FIG. 5C, the biasing scheme for the input voltages at the high end of the input voltage range, e.g., from about 16V to 18V, is shown. When the input voltage is in this high range, only the NMOS input transistors are coupled to the conventional inputs. That is, the NMOS of the operational amplifier negative input is coupled to the operational amplifier output and the NMOS of the operational amplifier positive input is coupled to the input voltage. However, the PMOS transistors of the inputs are biased with Vcm (e.g., 9V). The approach of FIG. 5C ensures that the PMOS transistors are fully on (when they would otherwise have been off (or very weakly on) in conventional schemes) at the high end of the range of input voltages so these PMOS transistors can contribute offset for RMS offset compensation.

From a structural standpoint, the modification requires only the addition of four switches to allow for individual biasing of the NMOS and PMOS transistors of the operational amplifier inputs, assuming of course that each input has only one-pair of differential input transistor pairs.

The results of the biasing scheme can be seen in the simulation results shown in FIG. 6. As can be seen in FIG. 6, by biasing the transistors of the operational amplifier inputs using this improved biasing scheme for the low and high ends of the input voltage range, the RMS off set is dramatically reduced. Specifically, the RMS offset is under 3 mv for all voltages in the illustrated input range.

Figure 7:
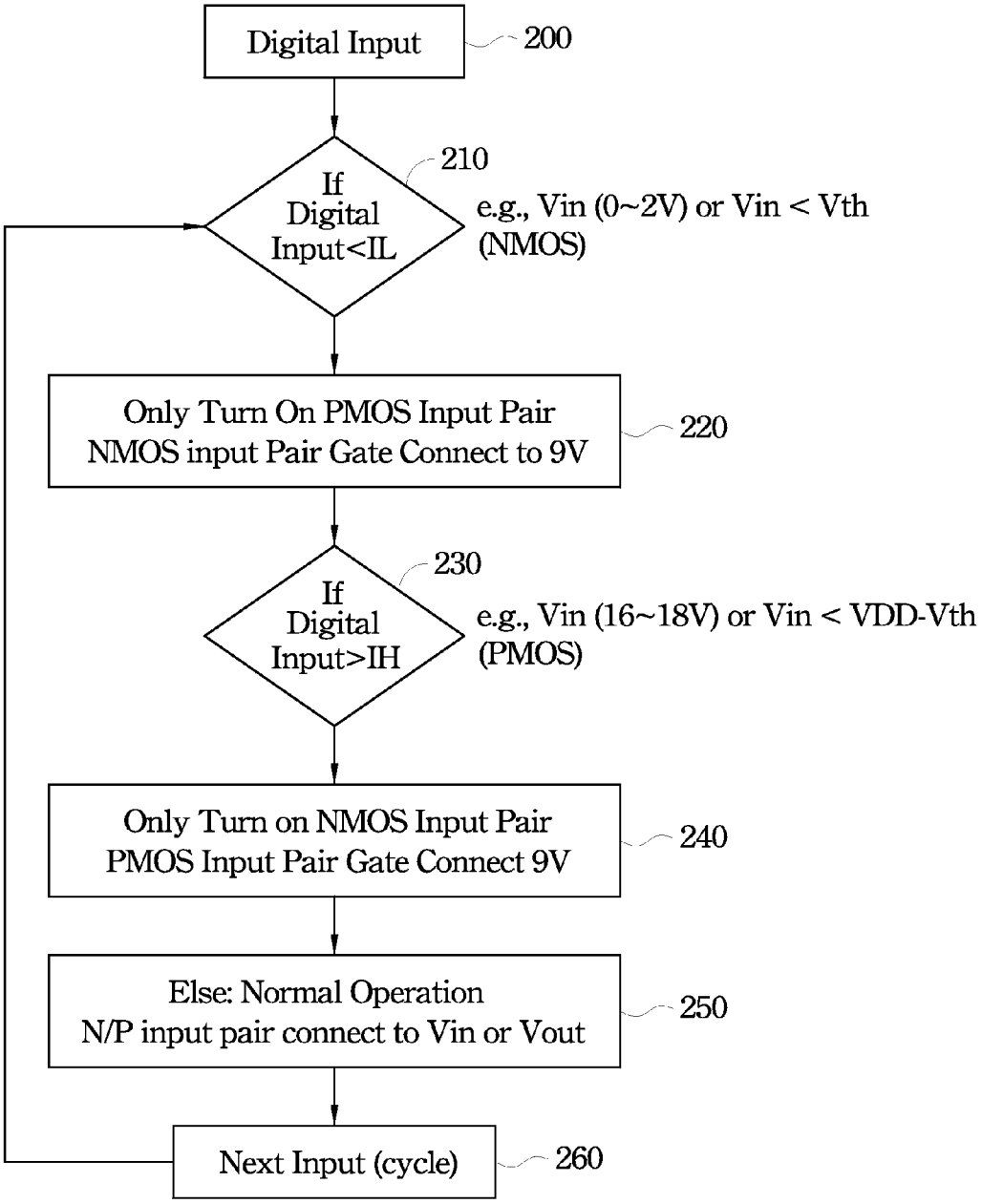
FIG. 7 illustrates an embodiment of a method of reducing RMS offset.

FIG. 7 illustrates a method of biasing the input transistors of the inputs terminals of an operational amplifier to reduce RMS offset. At step 200, a digital input is received. This digital input can be used to determine whether the input voltage will be at the upper or lower end of the input voltage range, or in between. For example, in a 10-bit resolution driver, if the digital input is from 0000000000 to 0001110000, then the input voltage is at the lower end of the input range and if the digital input is from 1110001111 to 1111111111, then the input voltage is at the higher end of the of the input range. At step 210, the decision logic determines if the input voltage is less than a predetermined low reference voltage value (e.g., at or around the threshold voltage of the NMOS transistors of the operational amplifier inputs). By way of example, if the threshold voltage is about 1.6 to 1.8V for a high voltage device, the predetermined low reference voltage may be set to about 2V. It is not necessary to make an analog voltage comparison at this step. As noted above, the input voltage level can be determined from the digital input code (step 200) and compared to some digital threshold code ("IL" in step 210). In digital circuits, this comparison or calculation can be made using a simple comparator/subtractor structure. At step 220, if the input voltage is determined to be at the low end of the input voltage range, then the PMOS transistors of the inputs are biased in the conventional manner and the NMOS transistors are connected to Vcm (FIG. 5A). At step 230 it is determined if the input voltage is at the high end of the input voltage range, specifically if the voltage is above a predetermined high reference voltage value (e.g., VDD-Vth of the PMOS transistors) or VDD minus a value slightly larger than Vth (PMOS), e.g., 2V. If the input voltage is above the predetermined high reference voltage value, then at step 240 the NMOS transistors of the operational amplifier inputs are biased in the conventional manner and the PMOS transistors are connected to Vcm (FIG. 5C). At step 250, assuming the input voltage is not determined to be below the predetermined low reference voltage level or above the predetermined high reference voltage level, then the normal biasing conditions for the NMOS/PMOS transistors of the operational amplifier are used (FIG. 5B). Finally, at step 260, the next digital input is received and the process begins again.

Figure 8:
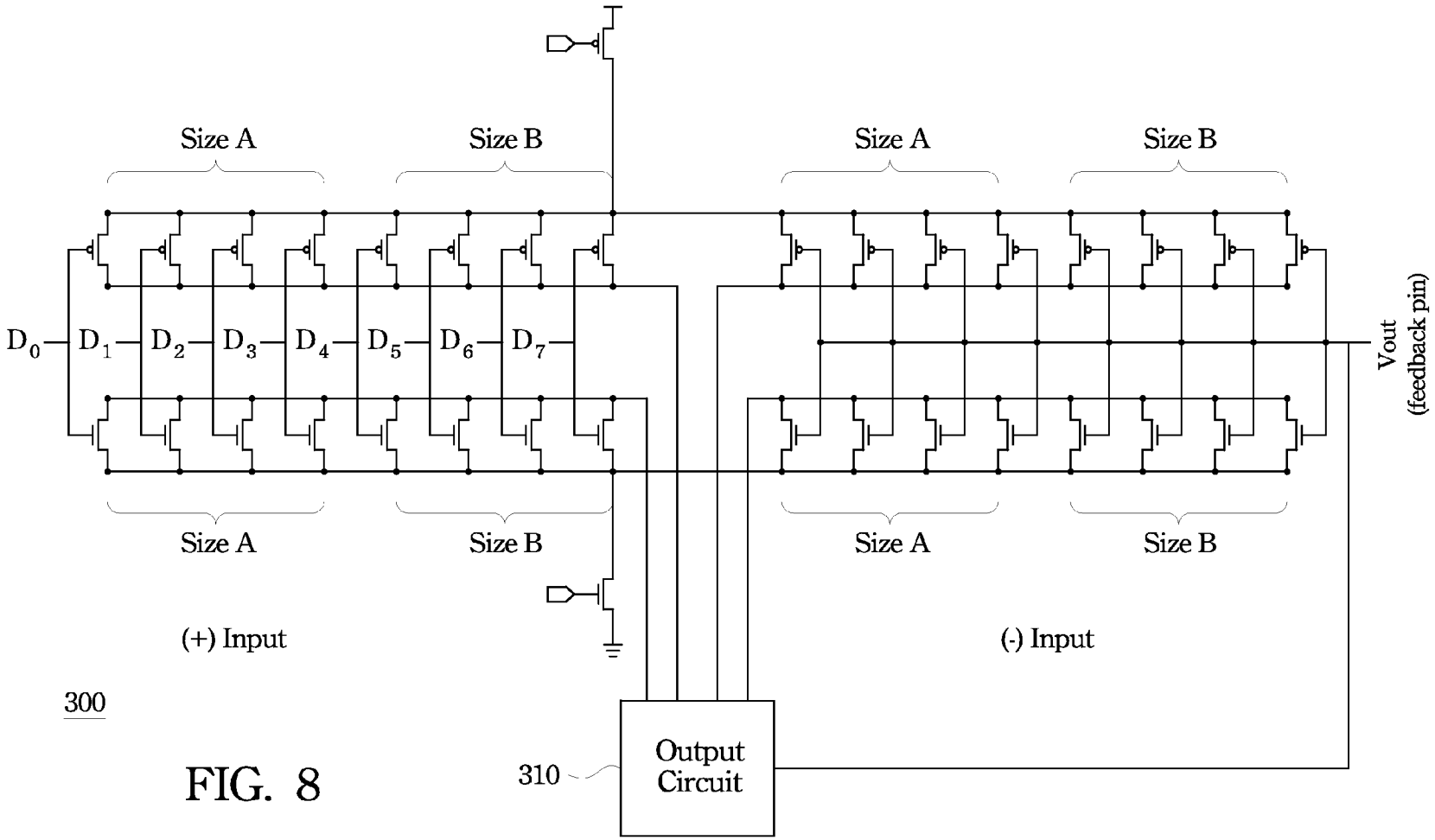
FIG. 8 illustrates an operational amplifier having a segmented architecture for improving linearity.

As noted above, splitting the DAC architecture into two DACs, one being a convention resistor tree DAC and the other being an embedded DAC within a buffer operational amplifier, as shown in FIGS. 1 and 2, can greatly reduce the size of the driver architecture. However, the approach of Kang et al. sizes all of its input transistors in the embedded DAC the same size. This leads to linearity problems in the output voltage. FIG. 8 illustrates an alternative embodiment of an operational amplifier buffer 300 having an embedded 3-bit DAC. The buffer 300 includes an output circuit 310, which may be of conventional design such as output circuit 115 shown in FIG. 4. The positive (+) input of the operational amplifier buffer 300 is shown on the left side of FIG. 3 and the negative (−) input of the operational amplifier buffer 300 is shown on the right side of FIG. 3. The positive input includes 8 NMOS/PMOS transistor pairs having gate terminals coupled to analog output signals $D_0$ to $D_7$ from a 3-bit decoder 20 as described above in connection with FIG. 2. As described above, each output signal $D_0$ to $D_7$ is set to either VH or VL depending on the 3 bit code received by the 3-bit decoder. Likewise, the negative input has 8 NMOS/PMOS transistor pairs having gate terminals coupled to the output node of the operational amplifier. That is, the output of the operational amplifier is fed back to the negative input. For operational amplifier matching, the positive (+) and negative (−) input should be identical in number to minimize offset. So when positive (+) input has eight differential input pairs for embedding the 3-bit DAC in the operational amplifier, the negative (−) input should also include eight differential pairs for matching purposes and offset reduction.

Of particular note, and unlike the operational amplifier buffer shown in FIG. 2, the NMOS/PMOS transistors pairs of the positive and negative inputs are segmented into subgroups having sizes that are calibrated to minimize the differential nonlinearity (DNL) and integral nonlinearity (INL) of the operational amplifier buffer 300. For example, as shown in FIG. 8, the NMOS/PMOS transistor pairs are divided into two segments. That is, a first group of the NMOS/PMOS input transistors for each of the positive and negative inputs is sized to have a first size parameter (group/segment A) and a second group of the NMOS/PMOS input transistors for each of the positive and negative inputs is sized to have a second size parameter (group/segment B). If the transistors are broken into two segments, then 4 pairs of NMOS/PMOS input transistors for each input are sized the same and the remaining four pairs of NMOS/PMOS input transistors for that input are sized the same. If the transistors are broken into four segments, then the eight NMOS/PMOS pairs of each input are broken into four size groups of NMOS/PMOS transistor pairs (two pairs per group). In an embodiment, the transistors can be broken into eight segments by size, one transistor pair per group. Of course, it should be understood that if the embedded DAC were a 4-bit DAC, then each input would have sixteen pairs of NMOS/PMOS input transistor pairs, which could be grouped into 2, 4, 8 or 16 segments by size.

By way of example, assume that the differential input pairs of transistors are broken into two segments. With respect to the design of FIG. 2 where all differential input transistors have the same size, in the design of FIG. 8, the transistors in group A would have a smaller size than the single-sized transistors of FIG. 2 (e.g., about −3%) and the transistors in group B would have a larger size than the single-sized transistors of FIG. 2 (e.g., about +3%). In exemplary embodiments, the width of the transistors in different segments may differ.

Kang et al.'s architecture (FIG. 2) uses a polarity changing methodology to improve the performance but do not specifically address the problem of linearity. Kang et al. report that the measured INL and DNL for their circuit architecture of FIG. 2 are less than 0.13 LSB. LSB means "least significant bit" and is a unit of measurement for non-linearity. However, these linearity numbers are good because Kang et al. only measure INL and DNL when the DAC operational amplifier output range is not close to ground voltage (e.g., around (0.1V)) or close to the high power supply voltage (e.g., VDD-0.1V). Simulations were performed that show that using a design as shown in FIG. 2, where all input transistors have the same size, the DNL and INL of an embedded 2-bit DAC architecture would be 0.238 and 0.349 LSB, respectively at the higher and lower ends of the input range. The nonlinearity degrades when embedding higher bit order DACs in the operational amplifier of Kang et al.'s architecture. If the architecture is used for a 3-bit DAC architecture, the worst case DNL and INL increase significantly to about 0.522 and 1.145 LSB, respectively. This level of non-linearity will degrade the performance of the DAC significantly. In contrast, simulations have shown that the segmented DAC architecture can improve INL even when the DAC operational amplifier output voltage is within 0.1V of ground or VDD. The design of the 10-bit architecture with a 3-bit embedded DAC as shown in FIG. 8 has typical case INL of only 0.061 LSB and a worst case INL of only 0.365 LSB, which represents about a 68% improvement over the worst case INL of the design of FIG. 2.

It should be understood that the optimum sizes for the transistors in different transistor segments can be determined by calculation, by simulation, by trial and error or combination of these techniques.

Figure 9:
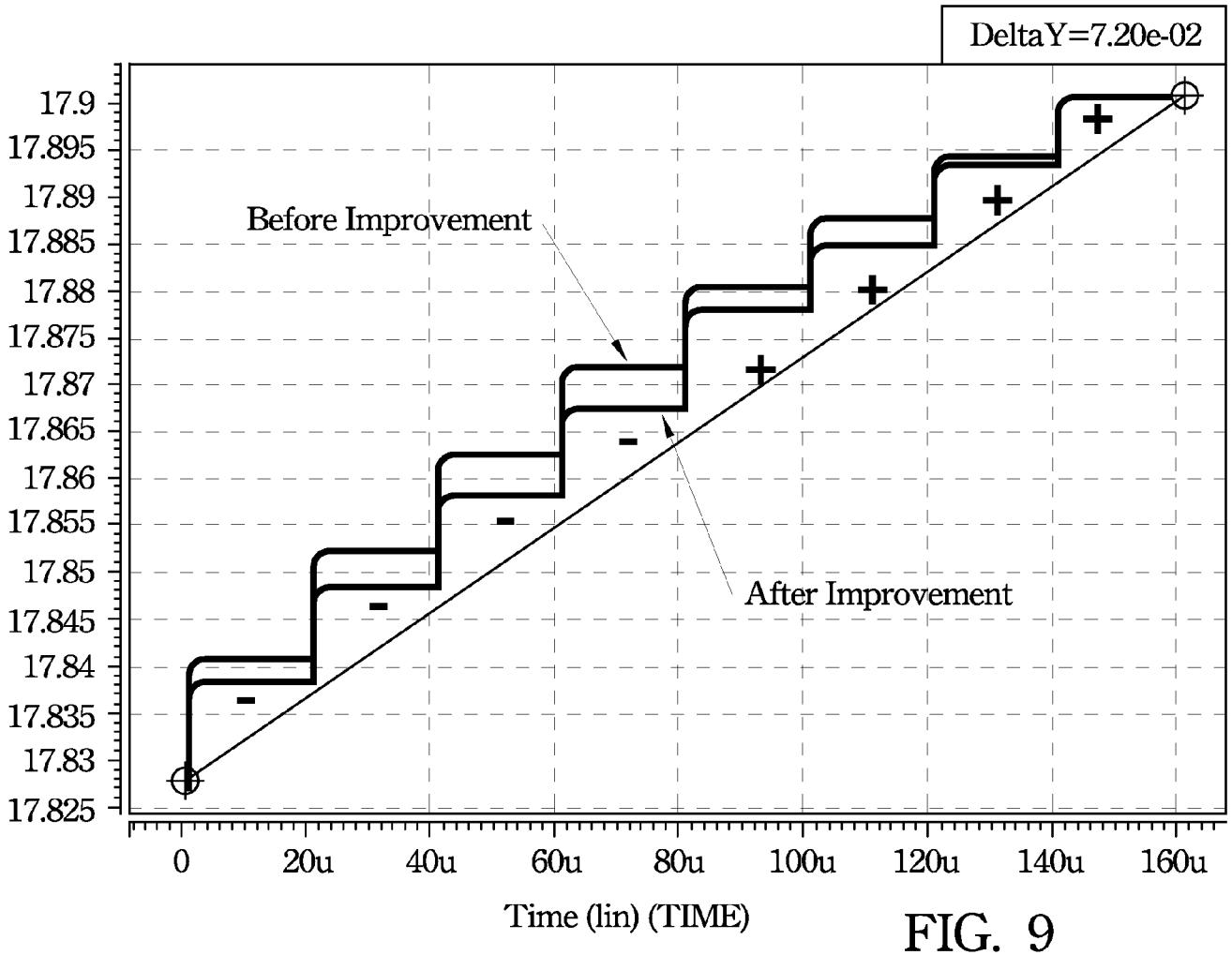
FIG. 9 is a graph of simulation results illustrating improvements in linearity using the architecture of FIG. 8.

The improvements in linearity from the sizing technique were confirmed using simulations, as discussed above. A graphical illustration of one simulation showing the improved INL is shown in FIG. 9. The negative signs in FIG. 9 illustrate that the size of group A transistors is made smaller to compensate for linearity and the positive signs illustrate that the size of group B transistors is made larger to compensate for linearity.

Figure 10:
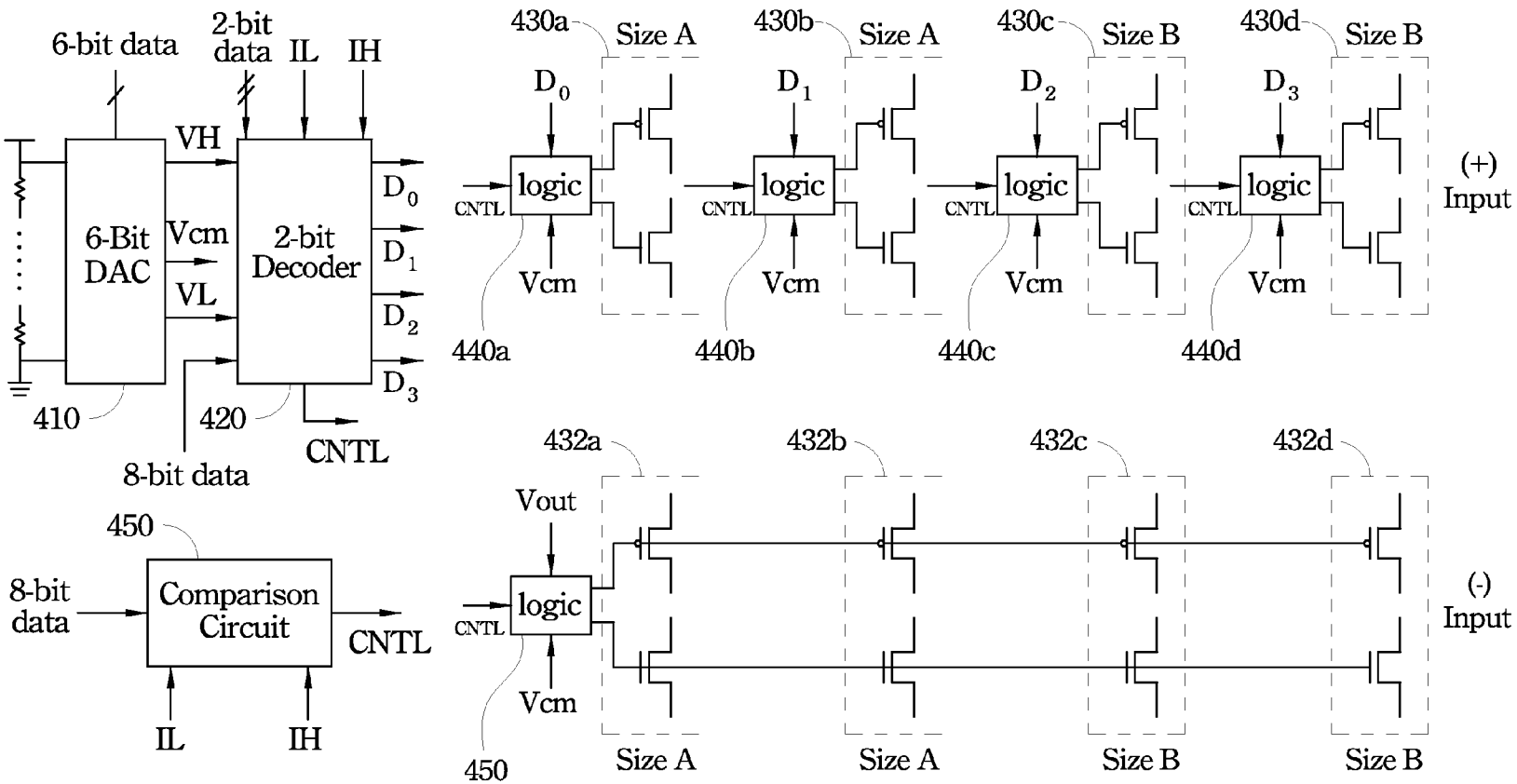
FIG. 10 illustrates an 8-bit driver system employing both offset cancelation and linearity improvement techniques according to an embodiment of the present invention.

FIG. 10 illustrates the incorporation of the selective biasing technique (FIGS. 5A to 5C) for off-set cancelation with the segmented sizing architecture for improved linearity (FIG. 8) in a single 8-bit architecture. It should be understood that the 8-bit architecture is shown for illustrative purposes only and those of ordinary skill in this field will be able to modify this 8-bit architecture for 10-bit or higher order architectures based on the description provided herein.

As shown in FIG. 10, the 8-bit architecture 400 has a 6-bit DAC 410 having VH and VL outputs coupled to a 2-bit decoder 420. The DAC 410 is also illustrated as being the source of the common mode voltage Vcm though it should be understood that this is not a requirement and Vcm can be provided from other sources. The decoder 420, as conventional, receives the two least significant bits of an 8-bit input code and provides 4 analog output data elements $D_0$ to $D_4$, which are either VH or VL depending on the input code. The decoder 420 is also shown as providing a control signal or signals CNTL, which represents whether the input voltage is below a predetermined threshold voltage (e.g., Vth (NMOS)), above a predetermine threshold voltage (e.g., Vdd-Vth (PMOS)) or between the threshold voltages. This control signal CNTL is used to determine the proper biasing as discussed above in connection with FIGS. 5A, 5B, 5C and 7. The 2-bit decoder 420 uses the 8-bit data signal, IL an IH to provide signal(s) CNTL. Alternatively, rather than building the comparison functionality into the decoder, a separate comparison circuit 450 may be provided for generating control signal CNTL.

For simplicity of illustration, FIG. 10 does not show the output circuit portion of operational amplifier, or the connections of the input differential pairs of transistors to such section, but it should be understood that such connections would be made in accordance with the other illustrations of operational amplifiers made herein, such as the operational amplifier illustrated in FIG. 4. The embedded 2-bit DAC includes four differential transistors pairs 430*a* to 430*d* forming the positive (+) input of the operational amplifier and 4 differential transistors pairs 432*a* to 432*d* forming the negative (−) input of the operational amplifier. As described above, the gates of the differential transistors pairs 432 that form the negative input are coupled to the feedback output VOUT, although in the illustrated embodiment the transistors are so coupled through logic 450. Logic 450 implements the functionality discussed above for selectively biasing (i) the NMOS/PMOS transistors of pairs 432 together to VOUT during normal operation, (ii) the PMOS transistors to VOUT and the NMOS transistors to the common mode voltage Vcm when the input voltage is below the low predetermined voltage, and (iii) the NMOS transistors to VOUT and the PMOS transistors to Vcm when the input voltage is above the high predetermine voltage. This logic section 450 can be a simple switching circuit responsive to one or more control signals CNTL for selectively switching either VOUT or Vcm to the gates of the NMOS and PMOS transistors of the input pairs 432.

The transistors of the four differential transistors pairs 430*a* to 430*d* that form the positive (+) input of the operational amplifier are biased from corresponding logic sections 440*a* to 440*d*. The gates of the differential transistors pairs 430 are selectively biased with either the analog output for that input pair (i.e., either $D_0$, $D_1$, $D_2$ or $D_3$, which is either VH or VL according to the 2 bit input code to the decoder 420) or Vcm under control of the control signal(s) CNTL. More specifically, logic sections 440 implement the functionality discussed above for selectively biasing (i) the NMOS/PMOS transistors of a given pair 430 together to $D_x$ during normal operation, (ii) the PMOS transistors to $D_x$ and the NMOS transistor to the common mode voltage Vcm when the input voltage is below the low predetermined voltage, and (iii) the NMOS transistors to $D_x$ and the PMOS transistors to Vcm when the input voltage is above the high predetermine voltage. Each logic section 440 can be a simple switching circuit responsive to one or more control signals CNTL for selectively switching either $D_x$ or VCOM to the gates of the NMOS and PMOS transistors of the respective input pair 430. This biasing scheme helps reduce RMS offset.

As also illustrated in FIG. 10, the architecture employs the segmentation principles discussed above to improve the linearity of the operational amplifier. By way of example, the input pairs 430 and 432 can be broken into two or more segments by size. For example, pairs 430*a*, 430*b*, 432*a* and 432*b* can have transistors of Size A (e.g., transistors having a first width) and pairs 430*c*, 430*d*, 432*c* and 432*d* can have transistors of Size B (i.e., transistors having a second width different than the first width).

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A driver comprising:

a digital-to-analog converter (DAC) having a digital input representing an input voltage between first and second analog voltage levels and an analog output;

an operational amplifier having an output and first and second inputs, the first input having a first differential input pair of transistors comprising a first NMOS transistor and a first PMOS transistor, the second input having a second differential input pair of transistors comprising a second NMOS transistor and a second PMOS transistor; and switching logic for reducing offset in the operational amplifier, the switching logic operable to selectively couple:

the first NMOS and PMOS transistors to the analog output of the DAC and the second NMOS and PMOS transistors to the operational amplifier output when the input voltage is between a low reference voltage and a high reference voltage;

the first and second NMOS transistors to an intermediate voltage between the low and high reference voltages, the first PMOS transistor to the analog output of the DAC and the second PMOS transistor to the operational amplifier output when the input voltage is below the low reference voltage; and the first and second PMOS transistors to the intermediate voltage, the first NMOS transistor to the analog output of the DAC and the second NMOS transistor to the operational amplifier output when the input voltage is above the high reference voltage.

2. The driver of claim 1, wherein the low reference voltage is about equal to the threshold voltage of the first and second NMOS transistors, and the high voltage is about equal to the difference between the second analog voltage level and the threshold voltage of the first and second PMOS transistors.

3. The driver of claim 2, wherein the intermediate voltage is sufficient to fully turn on the NMOS and PMOS transistors.

4. The driver of claim 3, wherein the intermediate voltage is a common mode voltage between the first and second analog voltage levels.

5. An operational amplifier buffer having an embedded digital to analog converter comprising:

a decoder having inputs for receiving first and second voltages and an n-bit input code, the decoder having $2^n$ number of outputs, each output being individually set to either the first or second voltage dependent on the input code;

a first operational amplifier input coupled to the decoder, the first operational amplifier including a first group of differential input pairs of transistors, each differential input pair being coupled to a respective one of the outputs of the decoder;

a second operational amplifier input, the second operational input being coupled to an output of the operational amplifier, the second operational input comprising a second group of differential input pairs of transistors, each differential input pair being coupled to the output of the operational amplifier, wherein the first and second groups each include at least first and second subgroups of differential input pairs of transistors, the first subgroup comprising at least one differential input pair of transistors fabricated in accordance with a first size parameter and the second subgroup comprising at least one differential input pair of transistors fabricated in accordance with a second size parameter different than the first size parameter; and an output circuit having inputs coupled to the first and second groups of differential input pairs of transistors and an output corresponding to the output of the operational amplifier, wherein each differential input pair of transistors corn rises an NMOS transistor and a PMOS transistor, the operational amplifier further comprising:

switching logic for reducing, offset in the operational amplifier, the switching logic being coupled between the outputs of the decoder and the first operational amplifier input, and between the output of the operational amplifier and the second operational amplifier input, the switching logic being operable to selectively couple:

the NMOS and PMOS transistors of the first group of differential input pairs of transistors to the outputs of the decoder and the NMOS and PMOS transistors of the second group different input pairs of transistors to the operational amplifier output when a target output voltage is between a low reference voltage and a high reference voltage;

the NMOS transistors of both first and second groups to an intermediate voltage between the low and high reference voltages, the PMOS transistors of the first group to the outputs of the decoder and the PMOS transistors of the second group to the operational amplifier output when the target voltage is below the low reference voltage; and the PMOS transistors of both first and second groups to the intermediate voltage, the NMOS transistors of the first group to the outputs of the decoder, and the NMOS transistors of the second group to the operational amplifier output when the target voltage is above the high reference voltage.

6. The operational amplifier buffer of claim 5, wherein the first and second size parameters are calibrated to compensate for non-linearities in the operation of the operational amplifier.

7. The operational amplifier buffer of claim 5, wherein the first and second parameters correspond to widths of the transistors, and the second size parameter is greater than the first size parameter.

8. The operational amplifier buffer of claim 5, wherein the at least two subgroups comprises three or more subgroups each having a different size parameter calibrated for compensating for non-linearities in the operation of the operational amplifier.

9. The operational amplifier buffer of claim 5, wherein the low reference voltage is about equal to the threshold voltage of the NMOS transistors of the first and second groups, and the high voltage is about equal to the difference between a highest output voltage level of the decoder and the threshold voltage of the PMOS transistors of the first and second group.

10. The operational amplifier buffer of claim 9, wherein the intermediate voltage is sufficient to fully turn on the NMOS and PMOS transistors.

11. The operational amplifier buffer of claim 10, wherein the intermediate voltage is a common mode voltage between the highest output voltage level of the decoder and a lowest voltage output level of the decoder.

12. An n-bit driver system responsive to a n-bit input code representative of a target voltage, the n-bit input code having a x-number of most significant bits and y-number of least significant bits, wherein x plus y equals n, comprising:

a first digital-to-analog converter (DAC) responsive to an input code comprising the x number of most significant bits to provide first and second DAC output voltages;

a second DAC, the second DAC comprising:

a y-bit decoder, the y-bit decoder receiving an input code comprising the y-number of least significant bits and the first and second DAC output voltages and providing $2^y$ number of outputs, each output being individually set to either the first or second voltage dependent on the input code to the y-bit decoder;

an operational amplifier having positive and negative inputs terminals and an operational amplifier output, the positive input terminal comprising a first group of differential input transistor pairs corresponding to the outputs of the decoder, the negative input terminal comprising a second group of differential input transistor pairs, the first and second groups each including $2^y$ number of differential input transistor pairs, each differential input transistor pair comprising an NMOS transistor and a PMOS transistor, the operational amplifier further comprising an output circuit coupled to the first and second groups and having an output corresponding to the operational amplifier output; and means for biasing the positive and negative input terminals of the operational amplifier to reduce offset in the operational amplifier, the biasing means:

when the target voltage is between a low reference voltage and a high reference voltage, coupling the NMOS and PMOS transistors of the first group to the outputs of the decoder and coupling the NMOS and PMOS transistors of the second group to the operational amplifier output;

when the target voltage is below the low reference voltage, turning on the NMOS transistors of both first and second groups, coupling the PMOS transistors of the first group to the outputs of the decoder and coupling the PMOS transistors of the second group to the operational amplifier output; and when the target voltage is above the high reference voltage, turning on the PMOS transistors of both first and second groups, coupling the NMOS transistors of the tint group to the outputs of the decoder, and coupling the NMOS transistors of the second group to the operational amplifier output.

13. The driver system of claim 12, wherein the first and second groups each include at least first and second subgroups of differential input pairs of transistors, the first subgroup comprising at least one differential input pair of transistors fabricated in accordance with a first size parameter and the second subgroup comprising at least one differential input pair of transistors fabricated in accordance with a second size parameter different than the first size parameter.

14. The driver system of claim 13, wherein the first and second size parameters are calibrated to compensate for non-linearities in the operation of the operational amplifier.

15. The driver system of claim 14, wherein the first and second parameters correspond to widths of the transistors, and the second size parameter is greater than the first size parameter.

16. The driver system of claim 13, wherein the at least two subgroups comprises three or more subgroups each having a different size parameter calibrated for compensating for non-linearities in the operation of the operational amplifier.

17. The driver system of claim 13, wherein driver system is a 10-bit driver system and x is 7 and y is 3.

18. The driver system of claim 13, wherein the low reference voltage is about equal to the threshold voltage of the first and second NMOS transistors, and the high voltage is about equal to the difference between the second analog voltage level and the threshold voltage of the first and second PMOS transistors.

19. The driver system of claim 12, wherein the driver is configured to provide output voltages between a maximum voltage and a minimum voltage, and the biasing means couples the NMOS and PMOS transistors to a common mode voltage between the maximum and minimum voltages to turn the transistors on.

* * * * *

UNITED STATES PATENT AND TRADEMARK OFFICE

CERTIFICATE OF CORRECTION

PATENT NO. : 8,476,971 B2
APPLICATION NO. : 12/889492
DATED : July 2, 2013
INVENTOR(S) : Yung-Chow Peng et al.

It is certified that error appears in the above-identified patent and that said Letters Patent is hereby corrected as shown below:

IN THE CLAIMS:

Claim 5, Column 10, Line 35, delete “corn rises” and insert -- comprises --.

Claim 5, Column 10, Line 47, delete “group different” and insert -- group of differential --.

Claim 12, Column 12, Line 14, delete “tint” and insert -- first --.

Signed and Sealed this
Twenty-fourth Day of June, 2014

Michelle K. Lee

Michelle K. Lee
*Deputy Director of the United States Patent and Trademark Office*